US006841120B2

(12) United States Patent
Grassi et al.

(10) Patent No.: US 6,841,120 B2
(45) Date of Patent: Jan. 11, 2005

(54) DISPENSING APPARATUS AND METHOD

(75) Inventors: John R. Grassi, Shaker Heights, OH (US); John Campbell, West Malvern (GB)

(73) Assignee: Alotech Ltd. LLC, Beachwood, OH (US)

( * ) Notice: Subject to any disclaimer, the term of this patent is extended or adjusted under 35 U.S.C. 154(b) by 81 days.

(21) Appl. No.: 10/171,175

(22) Filed: Jun. 13, 2002

(65) Prior Publication Data

US 2003/0230835 A1 Dec. 18, 2003

(51) Int. Cl.[7] ..... B22D 41/08
(52) U.S. Cl. ..... 266/45; 266/239; 222/595
(58) Field of Search ..... 266/239, 45; 222/590, 222/595; 164/306

(56) References Cited

U.S. PATENT DOCUMENTS

| | | | |
|---|---|---|---|
| 3,050,794 | A | 8/1962 | Holz |
| 3,430,685 | A | 3/1969 | Drugowitsch |
| 3,652,073 | A | 3/1972 | Lewis |
| 5,657,812 | A | 8/1997 | Walter et al. |
| 5,700,422 | A | 12/1997 | Usui et al. |
| 6,103,182 | A | 8/2000 | Campbell |

FOREIGN PATENT DOCUMENTS

| | | |
|---|---|---|
| DE | 26 48 730 | 5/1977 |
| EP | 0 506 025 | 9/1992 |
| EP | 0 812 639 | 12/1997 |
| EP | 0901854 A1 * | 3/1999 |
| GB | 1171295 | 11/1969 |
| WO | WO 98/33612 | 8/1998 |

* cited by examiner

*Primary Examiner*—Scott Kastler
(74) *Attorney, Agent, or Firm*—Fay, Sharpe, Fagan, Minnich & McKee, LLP

(57) ABSTRACT

An apparatus for dispensing a molten material from a reservoir of molten material includes a dispensing chamber in communication with the reservoir and a first valve adapted to regulate communication of the dispensing chamber with the reservoir. A riser communicates with the dispensing chamber for dispensing the molten material, and a second valve is adapted to regulate communication of the riser with the dispensing chamber. Also disclosed is a method for reducing the inclusion of oxides in a casting of a molten metal.

39 Claims, 7 Drawing Sheets

DISPENSING APPARATUS AND METHOD

FIELD OF THE INVENTION

The present invention relates to a dispensing apparatus for dispensing a molten material and to a method for dispensing a molten material into a mold by means of such an apparatus. More particularly, the present invention is directed toward an apparatus for dispensing a molten metal that reduces the inclusion of oxides in a casting of the metal.

BACKGROUND OF THE INVENTION

The transfer of liquid metal, in particular liquid aluminum, into molds to make castings is usually carried out by simply pouring under gravity. There are a number of severe disadvantages to this technique, in particular, the entrainment of air and oxides as the metal falls in a relatively uncontrolled way.

Counter-gravity is usually employed to avoid this problem. However, when making a series of castings using a counter-gravity system and a riser tube to supply metal to a mold, it has been found that if the metal is allowed to fall back down the riser tube during the process, oxides are immediately generated on the internal walls of the tube and subsequently carried into the next casting. The surface oxide exhibits the consistency of tissue paper and is easily folded into the melt, creating a folded film defect. In fact, the introduction of unwanted oxides into metal castings, especially in those applications using alloys having minimal or no silicon, is such a severe problem that often only the first casting is of an acceptable quality. All subsequent castings are unacceptable due to high oxide content.

To overcome the worst features of this method of mold filling, the so-called Low Pressure (LP) Casting Process was developed. In this technique the metal is held in a large bath or crucible, usually of at least 200-kg capacity of liquid metal, which is contained within a pressurizable enclosure known as a pressure vessel. The pressurization of this vessel with a low pressure (typically a small fraction such as 0.1 to 0.3 atmosphere) of air or other gas forces the liquid up a riser tube and into the mold cavity which is mounted above the pressure vessel.

The LP Casting Process suffers from the refilling of the internal crucible or bath. The metal has to be introduced into the vessel via a small door, through which a kind of funnel is inserted to guide the liquid metal from a refilling ladle through the door opening and into the pressure vessel. The fall into the funnel, the turbulent flow through the funnel and the final fall into the residual melt all re-introduce air and oxides to the liquid metal, the very contaminants that the process seeks to avoid.

Additional control problems occur in the filling of the mold because of the large size of the casting unit. First, the large volume of gas above the melt is of course highly compressible, and thus gives rather "soft" or "spongy" control over the rate of filling. Second, the problem is compounded because of the large mass of metal in the furnace, which needs to be accelerated by the application of the gas pressure. The problem is akin to attempting to accelerate (and subsequently decelerate) a battering ram weighing 200 kg or more by pulling on a few weak elastic bands.

The so-called Cosworth Process was designed to avoid this problem by the provision of melting and holding furnaces for the liquid metal, usually aluminum, which were joined at a common level, so that the metal flowed from one to the other in a tranquil manner. The liquid is finally transferred into the mold cavity by uphill transfer, using an electromagnetic (EM) pump which is permanently immersed in the melt, and which takes its metal from beneath the liquid surface, and moves it up a riser tube into the mold cavity without moving parts.

The control over the rate of flow of the metal is improved because the working volume in the pump and its delivery pipe is only a few kg. However, the driving force is merely the linkage of lines of magnetic flux, resembling the elastic bands in the mechanical analogy, so that control is not as precise as might first be thought.

Although there are many advantages to the Cosworth solution, the EM pump is not without its problems:

(i) It is expensive in capital and running costs. The high maintenance costs mainly arise as a result of the special castable grade of refractory for the submerged sections of the pump. These require regular replacement by a skilled person. In addition, they are subject to occasional catastrophic failure giving the various types of EM pumps a poor reputation for reliability. The disappointing trustworthiness is compounded by their extreme complexity and delicacy.

(ii) The relatively narrow passageways in the pump are prone to blockage. This can occur gradually by accretion, or suddenly by a single piece of foreign material.

(iii) Occasional voltage fluctuations cause troublesome overflows when the system is operating with the metal at the standby (bias) level.

(iv) At low metallostatic heads, the application of full power to the pump to accelerate the metal as quickly as possible sometimes results in a constriction of flow inside the pump as a result of the electrical pinch effect at high current density. If the pinch completely interrupts the channel of liquid metal current arcing will occur, causing damage, and temporarily stalling the flow. The pump has difficulty in recovering from the condition during that particular casting, with the consequence that the casting is filled at too low a speed, and is thus defective.

A number of attempts have been made to emulate the Cosworth Process using pneumatic dosing devices which are certainly capable of raising the liquid into the mold cavity. However, in general these attempts are impaired by the problem of turbulence during the filling of the pressurizable vessel, and by the large volume of the apparatus, thus suffering the twin problems of large mass to be accelerated and large compressible gas volume to effect this action.

One of the first inventions to answer these criticisms effectively is described in British Patent 1,171,295 applied for Nov. 25, 1965 by Reynolds and Coldrick. That invention provides a small pressure vessel that is lowered into a source of liquid metal. An opening at its base allows metal to enter. When levels inside and out are practically equalized, the base opening is closed. The small internal gas space above the enclosed liquid metal is now pressurized, forcing the metal up a riser tube and into the mold cavity. After the casting has solidified, the pressure in the pump can be allowed to fall back to atmospheric, allowing the metal to drain back down the riser tube. The base opening can be re-opened to refill the vessel, which is then ready for the next casting. The compact pneumatic pump has been proven to work well in service.

The only major problem in service when pumping liquid aluminum has been found to be the creation of oxides in the riser tube. These are created each time the melt rises and falls. Thus the riser tube may not only become blocked, but oxides which break free are carried into the casting and impair its quality, possibly resulting in the scrapping of the casting. As mentioned, this is a particular problem with low silicon melts.

In U.S. Pat. No. 6,103,182, the disclosure of which is incorporated herein by reference, an apparatus for dispensing liquid metal is disclosed in which the metal is held between castings in a dispensing riser tube at a "stand-by" level that is close to, or actually at, the top of the riser tube. This inhibits the formation of oxides in the tube and greatly reduces the presence of oxides in the final castings. While this apparatus solved the oxide problem, it is relatively complex and expensive to produce, calling for multiple chambers and seals to be placed within the apparatus. In addition, a problem occurs in that the relatively limited diameter of the riser tube allows the molten metal held therein to cool much more rapidly than does the molten metal in the pressure vessel.

Thus, an apparatus is needed for dispensing low silicon containing melts into a mold that inhibits the contamination of the castings with oxides, that is mechanically relatively simple, that keeps the melt in the riser tube hot, and that is easy and inexpensive to operate and produce.

SUMMARY OF THE INVENTION

The invention provides, in a first aspect, an apparatus for dispensing a molten material from a reservoir. The apparatus includes a dispensing chamber arranged to receive the molten material from the reservoir, a pressure variation means whereby the dispensing chamber can be pressurized, a first valve adapted to regulate communication of the dispensing chamber with the reservoir, a riser communicating with the dispensing chamber, and a second valve adapted to regulate communication of the dispensing chamber with the riser.

In a second aspect, the invention provides an apparatus for continuously dispensing a molten material from a reservoir. The apparatus includes two dispensing chambers arranged to receive the molten material from the reservoir, a first set of valves adapted to regulate communication of each of the dispensing chambers with the reservoir, at least one riser communicating with the two dispensing chambers for dispensing the molten material, and a second set of valves adapted to regulate communication of the riser with the dispensing chambers, such that the molten material can be maintained in the riser at a level above the level of the molten material in the chambers.

The invention provides, in a third aspect, a method of reducing the inclusion of oxides in a casting of a molten metal, including the steps of (i) providing a reservoir of molten metal, a dispensing chamber communicating with the reservoir and a riser communicating with the dispensing chamber;

(ii) flowing the molten metal from the reservoir into the dispensing chamber;

(iii) flowing the molten metal from the dispensing chamber into the riser;

(iv) discharging the molten metal from the riser;

(v) terminating the step of discharging;

(vi) holding the molten metal in the riser at a predetermined level above the level in the dispensing chamber; and (vii) heating the riser adjacent the predetermined level.

BRIEF DESCRIPTION OF THE DRAWINGS

The present invention will be described in detail with several preferred embodiments and illustrated, merely by way of example, in the accompanying drawings.

DETAILED DESCRIPTION OF THE PREFERRED EMBODIMENTS

Figure 1:
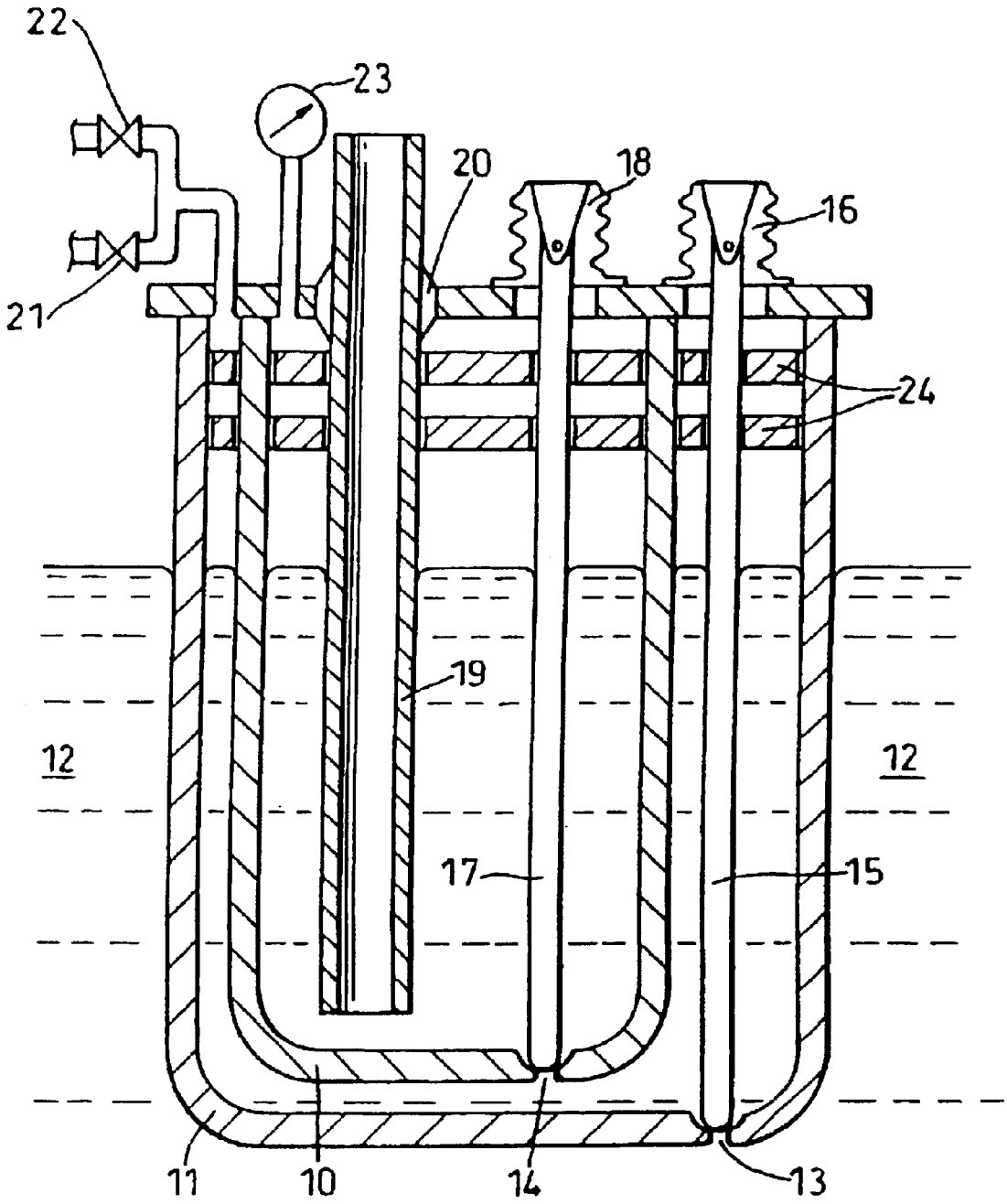
Fig. 1 PRIOR ART
FIG. 1 is a cross-sectional view of a prior art apparatus for dispensing molten metal.

With reference to FIG. 1, a prior art molten metal pump is shown as comprising a dispensing chamber 10 surrounded by and adapted to receive liquid metal or melt from an intermediate chamber 11. The intermediate chamber 11 is immersed in and adapted to receive liquid metal from a reservoir 12 of liquid metal.

Molten metal passes from the reservoir 12 to the intermediate chamber 11 and from the intermediate chamber 11 to the dispensing chamber 10 through intermediate chamber valve 13 and dispensing chamber valve 14 respectively. The intermediate chamber valve 13 is closable by means of a stopper-rod 15 operatively associated with a bellows 16. Similarly, dispensing chamber valve 14 is closable by means of a stopper-rod 17 operatively associated with a bellows 18. A riser tube 19 extends from the dispensing chamber 10 to a conventional mold (not shown). The riser tube is sealed relative to the chamber by means of a gas-tight seal 20.

The pressure in the two chambers is changed as required by the application of a vacuum through a first gas valve 21 and/or the admission of a pressurizing gas through a second gas valve 22. The pressure is indicated by means of a pressure gauge 23. A pair of heat shields 24 minimizes heat loss from the two chambers 10 and 11.

When the pump is lowered into the reservoir 12 of molten metal, the liquid metal enters both the chambers 10 and 11 as regulated by valves 13 and 14. The closing of the intermediate chamber valve 13 and the introduction of pressurized gas via the second gas valve 22 pressurizes both chambers, with the result that metal is forced up the riser tube 19 and into a mold to make a casting. The dispensing chamber valve 14 is then closed, sealing and isolating the dispensing chamber 10 so that the molten metal is kept at a level at or near the top of the riser and the intermediate chamber is refilled. The pump is now ready to repeat its cycle once a new mold is placed in position on the casting station.

Figure 2:
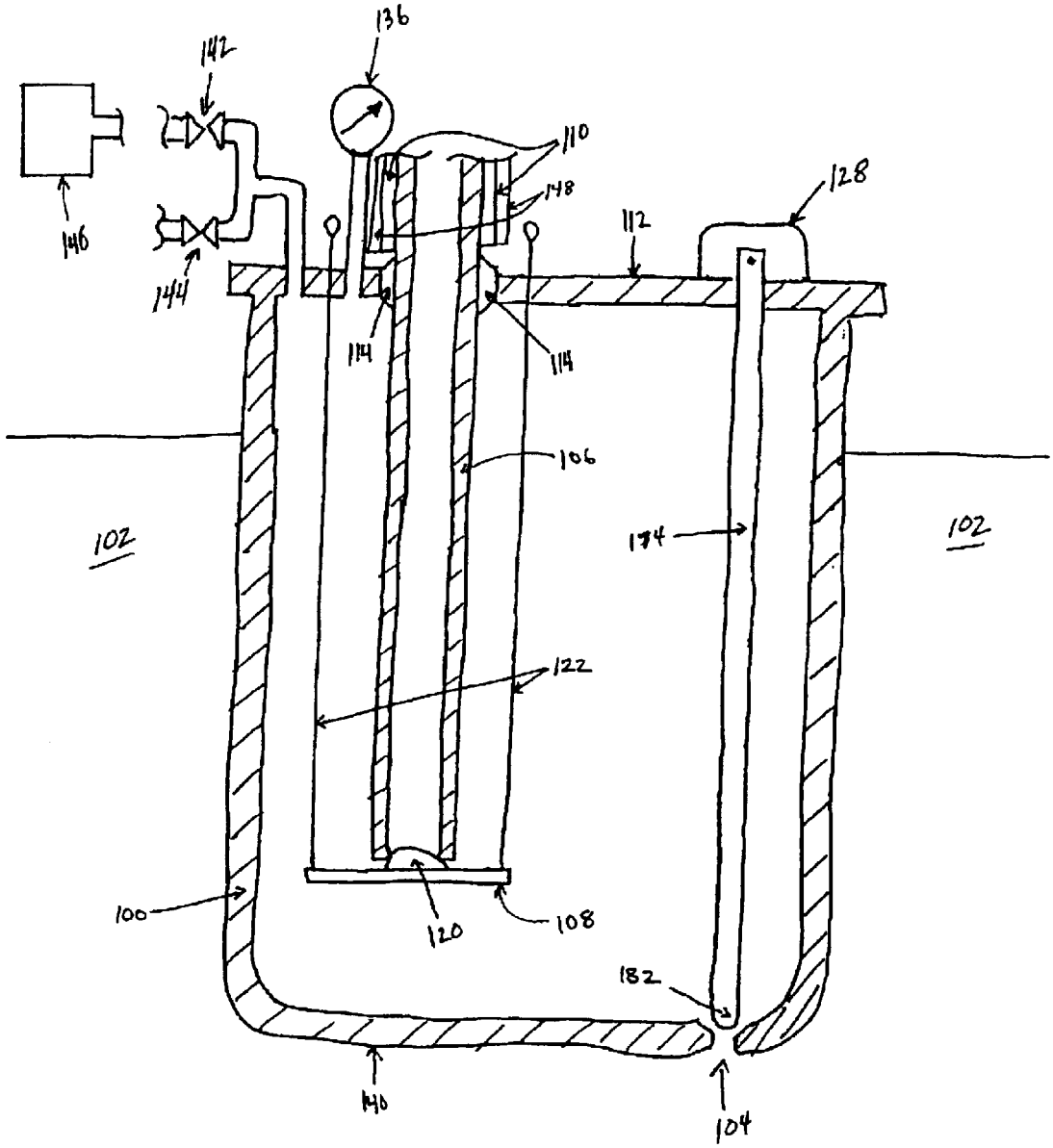
FIG. 2 is a cross-sectional view of an apparatus according to a first embodiment of the present invention.

The present invention retains all of the advantages of the prior art while being simpler to construct and easier to operate. It also has several additional benefits. With reference to FIG. 2, and in accordance with a first embodiment of the present invention, a molten metal pump is provided comprising a dispensing chamber 100 immersed in and adapted to receive molten material from a reservoir 102 through a first valve 104. A riser 106 extends from the dispensing chamber 100 to a conventional mold (not shown) and is adapted to receive melt from the dispensing chamber 100 through a second valve or riser valve 108. A first gas valve 142 allows for the introduction of pressurized gas from a gas reservoir 146 or the application of a vacuum in the dispensing chamber 100 while a second gas valve 144 is a vent that allows the dispensing chamber 100 to equalize to atmospheric pressure. Other conventional valve arrangements are contemplated that accomplish the same objectives.

In this embodiment, the riser 106 is disposed inside the dispensing chamber 100 and extends through a top surface 112 of the dispensing chamber. The riser 106 can be sealed relative to the dispensing chamber 100 at a point where it passes through the top surface 112 of the dispensing chamber by means of a gas-tight seal 114 (which may be, for example, a heat-insulating, ceramic-fiber-packed gland).

Preferably, a heater 110 encloses a part of the riser 106 that extends above the top surface 112 of the dispensing chamber 100. The heater 110 heats the riser 106 and prevents the molten material within the riser from cooling and solidifying as well as discouraging oxide formation. The heater 110 can be any type of heating mechanism capable of maintaining sufficient heat in the riser 106. For example, the entire pump apparatus can be situated in a furnace (not shown), with the furnace acting as a heater for the riser. Alternately, a conventional gas, electric resistance, inductance or other conventional type of heater can be used.

A layer of insulation 148 can be disposed around the outside of the heater 110 to improve the heating performance and to conserve energy. This insulation can comprise ceramic fiber or any other type of material known to provide insulating properties.

A pressure-monitoring device 136 such as a pressure gauge can be connected to the dispensing chamber. This can be used to monitor the pressure in the dispensing chamber 100 as dictated by the application of a vacuum and/or the admission of a pressurizing gas through first gas valve 142. The pressure reading can be measured and correlated to the height of the molten material in the riser.

The first valve 104 can be constructed in a variety of ways. For example, with reference to FIG. 6, automatic, or passive, closing can be effected by the use of a ball 116 of a refractory material of density higher than that of the liquid metal, which is located in a countersunk, conical valve seat 118 forming the entrance of the valve 104. A stopper rod 124 is used to prevent the ball 116 from becoming so far displaced from its conical valve seat 118 that it would not seat correctly subsequently. In a passive sealing system, the stopper rod 124 is fixed in place and acts merely to prevent the ball from lifting so high that it would be in danger of becoming permanently displaced from its conical seating 118. One drawback of such a passive sealing system is that it hinders the draining of the pump when the pump is lifted from the reservoir.

With continued reference to FIG. 2, the second valve 108 can be an active sealing system of suitable design such as a hemisphere 120 that engages the base of the riser tube 106 to form a seal. The hemispherical stop valve 120 is supported and actuated with a one or more rods 122 acting together and positioned on either side of the riser 106. However, both the passive sealing device of FIG. 6, namely the non-return ball valve, and the active sealing system of FIG. 2, namely the hemispherical rod-operated valve described above, are subject to leakage if a piece of debris prevents the proper seating of the ball or hemisphere.

Therefore, it should be appreciated that a variety of other known valve types can also be used for both the first and second valve 104 and 108. For example, as depicted in detail in FIG. 7, an active closing mechanism could be used in which a valve 164 is closed solely by means of a movable stopper rod 174. An end 182 of the stopper rod 174 may be hemispherically shaped to provide a better fit in a conical valve seat 168. In this embodiment, the stopper rod is vertically movable such that it can be raised and lowered to alternately seal and unseal against the conical valve seat 168 of a chamber 150.

With continued reference to FIG. 2, operatively associated with a movable stopper rod is a conventional manipulation and sealing assembly 128. In an active sealing mechanism as described above, this assembly can take various forms but must be able to permit vertical movement of the rod as well provide a gas-tight seal relative to the dispensing chamber 100. Preferably, the assembly 128 also allows rotation of the stopper rod 174 about its longitudinal axis. The closure force can be adjusted to reduce the incidence of leaks, such as employing a partial rotation of the rod after closing to assist the effectiveness of the seal.

Figure 6:
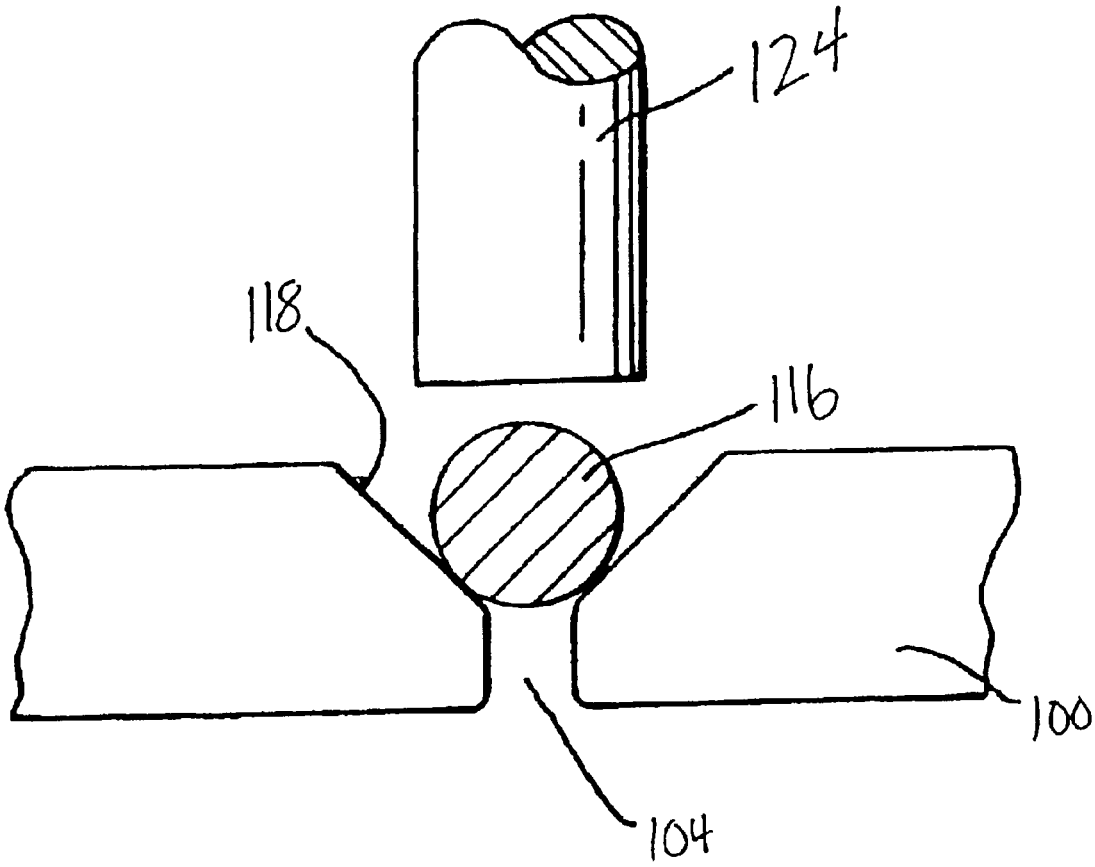
FIG. 6 is an enlarged side elevational view, partially in cross section and broken away, of a first type of valve suitable for use in the present invention.
Figure 7:
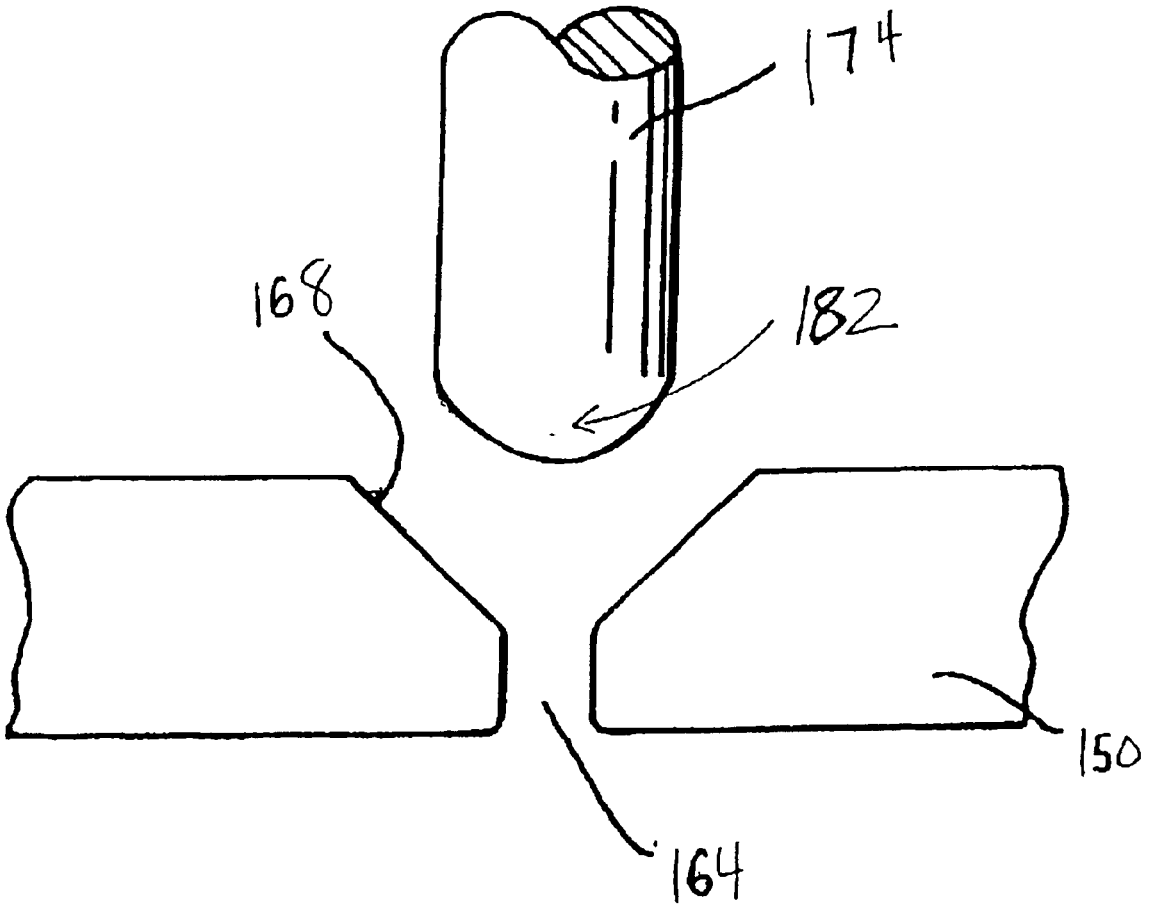
FIG. 7 is an enlarged side elevational view, partially broken away, of a second type of valve suitable for use in the present invention.

The active closing valve of FIG. 7 contrasts with the hemispherical stop valve 120 depicted in FIG. 2, which suffers from being a rather loose engineering structure that cannot transfer an effective twisting action, since any attempt to do so simply causes one or more rods used to move it to wind around the riser tube. The further advantage of the active sealing mechanism over the passive sealing valve shown in FIG. 6 is that the active seal allows the pump to be drained quickly if necessary.

For apparatus suitable for dispensing liquid aluminum and aluminum-based alloys, the dispensing chamber 100, valves 104, 108 and riser 106 can all be bought at modest cost from existing suppliers of crucibles, thermocouples and tubes, in commonly available materials such as clay/graphite, clay/SiC, or clay/fused silica refractories. Additional suitable materials include silicon carbide-based or silicon nitride-based materials or related ceramics such as sialon, and particularly fused silica-based refractories that have been converted to a mixture of corundum and aluminum. Some of these materials are designed to be especially damage-tolerant at temperature, becoming tough as their glassy phase bond partially softens. At operating temperature, such materials are designed to deform, rather than to fail in a brittle manner.

For apparatus suitable for dispensing liquid magnesium and magnesium-based alloys, the dispensing chamber 100, valves 104, 108 and riser 106 can all be fabricated from iron, mild steel or ferritic stainless steel. Thus, the material and the fabrication costs are relatively low and the material is resistant to brittle failure at temperature, so that the device itself is robust. The pressurizing gas can be dry air or dry carbon dioxide, both inexpensive gases, but rendered inert by the admixture of up to about 5 percent by volume of sulfur hexafluoride (or other more environmentally benign gas).

For dispensing higher-temperature liquid metals, the materials of the apparatus will become progressively more expensive. Such materials as SiC, SiN and SiAlONs (ceramics based on silicon/aluminum oxy-nitride) and possibly various oxide based ceramics may become necessary. A substantially inert pressurizing gas such as argon will also be required for such service.

The operation of the pump of FIG. 2 will now be described. When the dispensing chamber 100 is lowered into the reservoir 102 of molten metal, liquid metal enters both the dispensing chamber 100 and the riser 106 via open valves 104, 108. The metal level in both the dispensing chamber 100 and the riser 106 is equalized by allowing the gas in the chambers to vent to atmosphere via the second gas valve 144 and the riser tube 106.

The closing of valve 104 and the introduction of pressurized gas via the first gas valve 142 pressurizes the dispensing chamber 100, with the result that metal is forced up the riser tube 106 and into a mold (not shown) to make a casting. The valve 108 is then closed, sealing and isolating the riser 106 so that the molten metal is kept at a level at or near the top of the riser. Vent 144 and valve 104 are then opened to allow the depressurization of the dispensing chamber 100 and its refilling. The pressurized gas can be collected and reused to conserve the amount of gas needed for the process. The refilling phase can, of course, be speeded up by closing second gas valve 144, and applying a modest partial vacuum via the first gas valve 142. In this way the cycle time of the pump can be greatly increased. In addition, the technique of using the vacuum to aid the filling of the dispensing chamber 100 can be useful if the general liquid level in the reservoir 102 is low, allowing the dispensing chamber 100 to fill to a predetermined level that is higher than the level of the material in the reservoir 102.

When the dispensing chamber 100 is refilled, valve 104 can be closed. The pump is now ready to repeat its cycle once a new mold is placed in position on the casting station. The pressure in the dispensing chamber 100 is subsequently raised to that in the riser 106 and the valve 108 can then be opened. Continuing transfer of pressurized gas into the dispensing chamber 100 will then displace liquid metal, forcing it up and out of the riser 106. By continuing this process, a continuous cycle of refilling the dispensing chamber 100 and dispensing material from the riser 106 is performed, with material always remaining at a stand-by level in the riser at or near its top.

Figure 3:
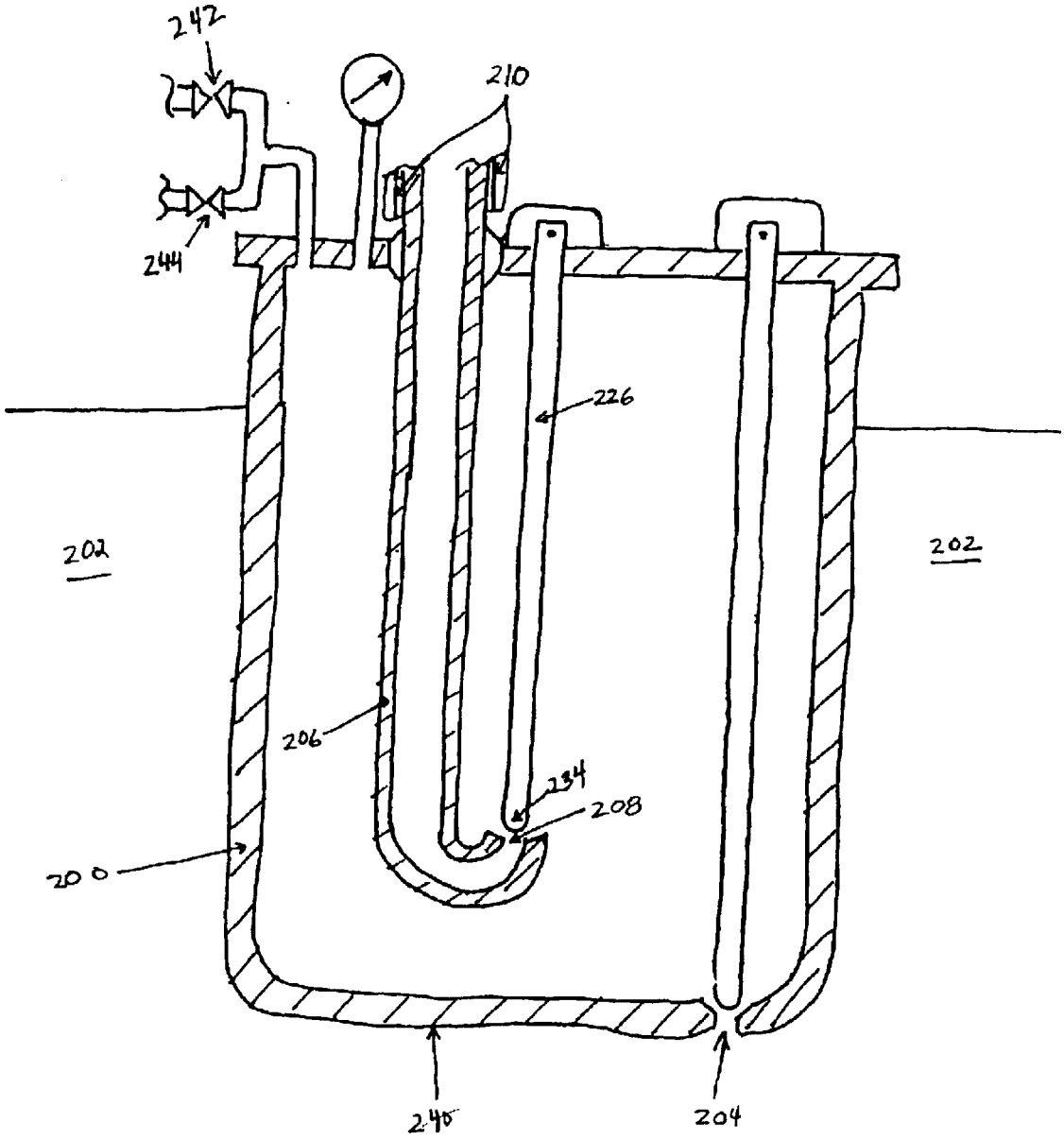
FIG. 3 is a cross-sectional view of an apparatus according to a second embodiment of the present invention.

With reference now to FIG. 3, a second preferred embodiment is shown in which a molten metal pump is provided comprising a dispensing chamber 200 immersed in and adapted to receive molten material from a reservoir 202 through a first valve 204. A riser 206 extends from the dispensing chamber 200 to a conventional mold (not shown) and is adapted to receive melt from the dispensing chamber 200 through a second valve or riser valve 208. A heater 210 is positioned around the portion of the riser 206 that extends out of the dispensing chamber 200. A first gas valve 242 allows for the introduction of pressurized gas or the application of a vacuum to the dispensing chamber 200 while a second gas valve 244 is a vent that allows the dispensing chamber 200 to equalize to atmospheric pressure.

In this embodiment, the first valve 204 and the second valve 208 are both of the type depicted in FIG. 6 or 7 and described above. Preferably, both of the valves 204, 208 are active closing valves as depicted in FIG. 7 without the use of a ball 116. In this regard, the riser 206 is provided with an upwardly facing conical seating for the riser valve 208 such that a second stopper rod 226 extends down from the top of the dispensing chamber 200 and sits evenly on the riser opening. When the second valve 208 is an active closing valve, an end 234 of the second stopper rod 226 is rounded to provide a seal. As noted, this type of valve arrangement allows for a better seal around the riser tube 206 opening than the arrangement depicted in FIG. 2. The operation of the embodiment of FIG. 3 is identical to the embodiment of FIG. 2.

Figure 4:
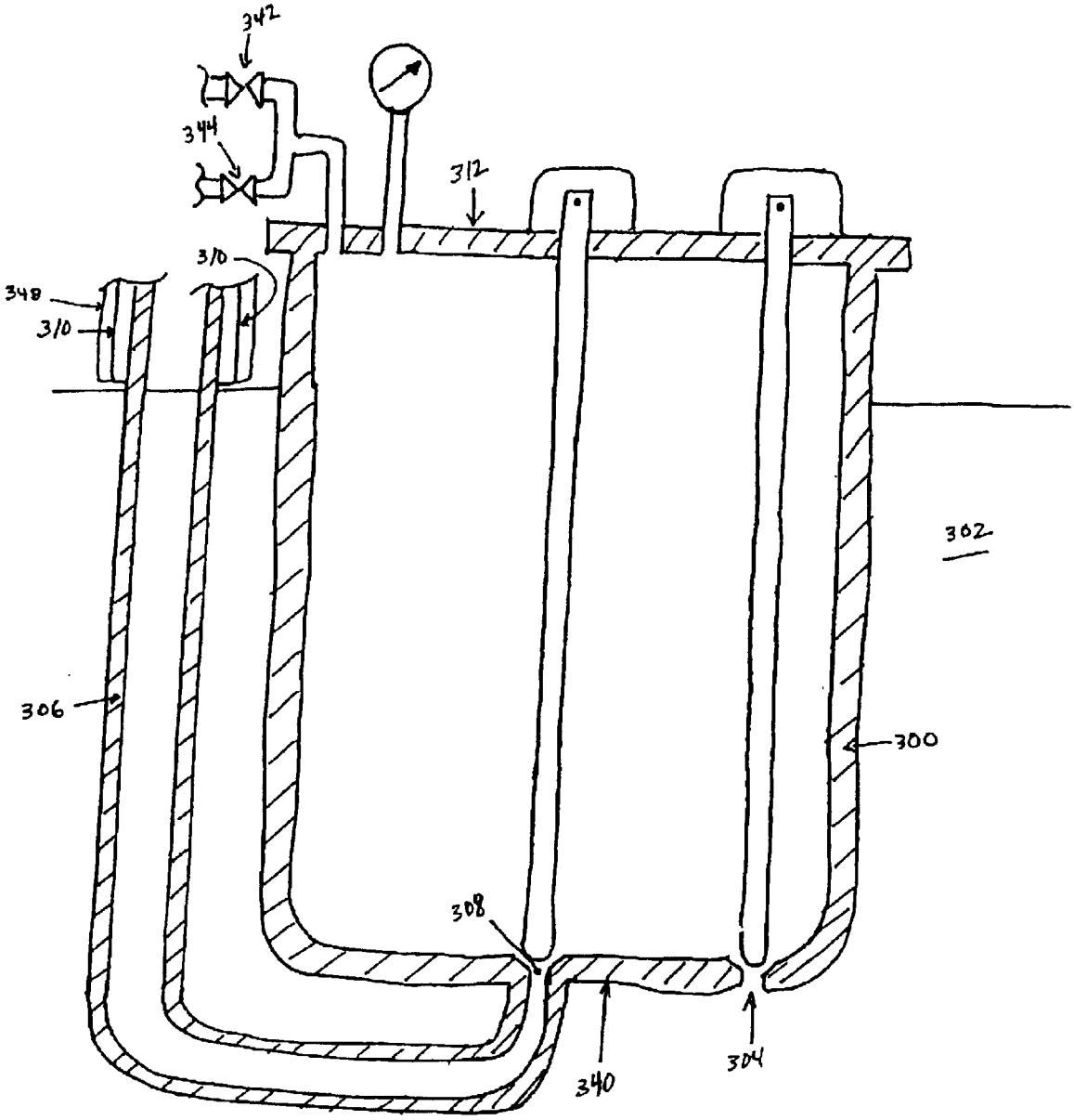
FIG. 4 is a cross-sectional view of an apparatus according to a third embodiment of the present invention.

In a third preferred embodiment, and with reference to FIG. 4, a riser 306 is located external to a dispensing chamber 300 located in a reservoir 302 of melt. Preferably, the riser 306 is J-shaped and is attached to a bottom surface 340 of the dispensing chamber 300. This embodiment maintains all the advantageous features of the previous embodiments. In addition, it provides the added benefit of eliminating the necessity of a gas-tight seal between the riser 306 and the top surface 312 of the dispensing chamber, as required in the first described embodiment depicted in FIG. 2. This is a difficult feature to manufacture, since it needs to hold the riser tube firmly without fracturing it, while also needing to be gas-tight and insulate the heat of the riser from the top surface of the dispensing chamber. Sealing the connection point of the riser 306 on the bottom surface 340 of the dispensing chamber is more easily done. This is because such a seal does not need to be made gas-tight, but only must present a seal against the leakage of liquid metal, which has a viscosity approximately two orders of magnitude greater than a typical pressurizing gas.

In addition, the placing of the riser 306 externally, some distance from the dispensing chamber 300 allows more room for a riser heater 310 as well as easily allowing positioning of a casting station (not shown) that does not obstruct access to the top surface 312.

As noted above, the heater 310 is positioned around the riser 306. The heater 310 will extend along a height of the riser 306 necessary to prevent the melt within the riser from cooling to a point where it becomes difficult to dispense. Thus, in this embodiment, the heater 310 may extend from some point above the level of the reservoir 302 to a point just below the top of the riser 306. An insulating layer 348 can surround the riser 306 radially outward of the heater 310. Gas valving 342, 344 and melt valving 304 and 308 is also provided. The operation of this embodiment is similar to that described for FIG. 2.

Figure 5:
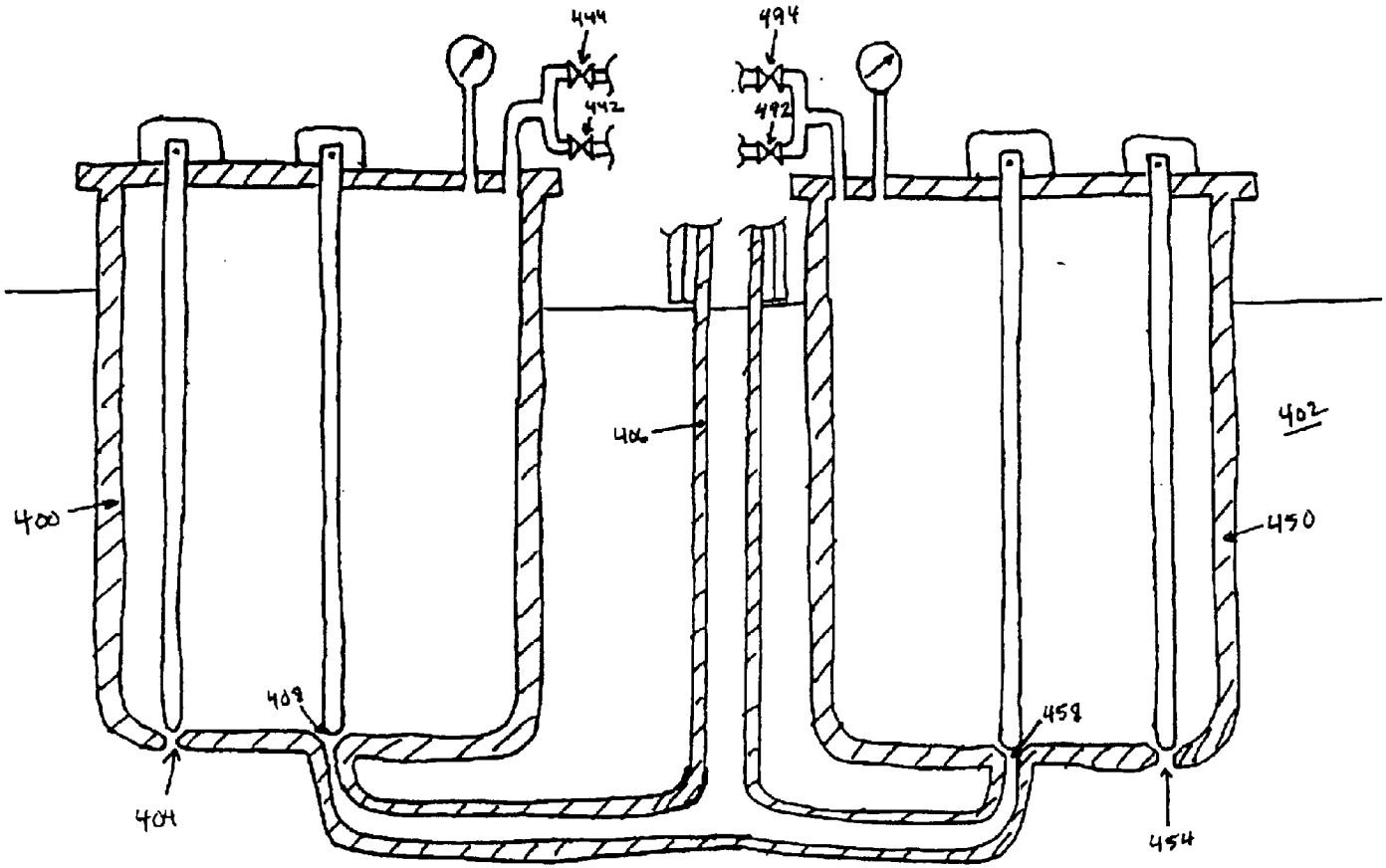
FIG. 5 is a cross-sectional view of an apparatus according to a fourth embodiment of the present invention.

In a fourth embodiment illustrated in FIG. 5, at least a first and a second dispensing chamber 400, 450 are connected to the same riser 406. Components of the second dispensing chamber 450 are identical with corresponding structures within the first dispensing chamber 400. Thus, only the first chamber will be discussed in detail herein, it being understood that the second dispensing chamber 450 has the identical structure. With this set-up, melt can be supplied continuously through a riser 406. The two (or more) pumps are coordinated so that one is a half (or an appropriate fraction) of a cycle behind the other. In this way, one pump will be dispensing the melt through the riser 406 while the other pump is refilling the dispensing chamber 400, 450 thus ensuring a continuous flow of melt from the riser. Alternately, the two pumps can be synchronized such that both pumps will dispense melt from the respective dispensing chambers 400, 450 through the riser 406 at the same time. In this arrangement, the amount of melt dispensed by the riser 406 during each cycle of operation will be twice that which would be dispensed if only one pump were connected to the riser. In either case, a larger mold can be filled more quickly.

The operation of the pump of FIG. 5 will now be described. When the dispensing chambers 400 and 450 are lowered into a reservoir 402 of molten metal, liquid metal enters both the dispensing chambers 400, 450 and the riser 406 via open valves 404, 408, 454, 458. The metal level in both the dispensing chambers 400, 450 and the riser 406 is equalized by allowing the gas in the chambers to vent to atmosphere via gas valves 444, 494 and the riser tube.

The closing of valves 404, 454 and the introduction of pressurized gas via gas valves 442, 492 pressurizes the dispensing chambers 400, 450, with the result that metal is forced up the riser tube 406 and into a mold (not shown) to make a casting. The valves 408, 458 are then closed, sealing and isolating the riser 406 so that the molten metal is kept at a level at or near the top of the riser. Vents 444, 494 and valves 404, 454 are then opened to allow the depressurization of the dispensing chambers 400, 450 and their refilling. The pressurized gas can be collected and reused to conserve the amount of gas needed for the process. The refilling phase can, of course, be speeded up by closing vents 444, 494, and applying a modest partial vacuum via valves 442, 492. In this way the cycle time of the pump can be greatly increased. In addition, the technique of using the vacuum to aid the filling of the dispensing chambers 400, 450 can be useful if the general melt level in the reservoir 402 is low, allowing the dispensing chambers 400, 450 to fill to a predetermined level that is higher than the level of the material in the reservoir.

When the dispensing chambers 400, 450 are refilled, valves 404, 454 can be closed. The pump is now ready to repeat its cycle once a new mold is placed in position on the casting station. The pressure in the dispensing chambers 400, 450 is subsequently raised to that in the riser 406 and the valves 408, 458 can then be opened. Continuing transfer of pressurized gas into the dispensing chambers 400, 450 will then displace liquid metal, forcing it up and out of the riser 406. By continuing this process, a faster rate of refilling the dispensing chambers 400, 450 and dispensing material from the riser 406 can be performed. To operate the pumps continuously, the pumps could be working in sequence while allowing material to always remain at a stand-by level in the riser at or near its top.

The pump as described in the previous embodiments is compact in size and mechanically relatively simple, thus entailing a low capital outlay. In addition, by pressurizing only a relatively small dispensing chamber rather than an entire reservoir, there is a reduced demand for gas, allowing inert gas to be used economically. This enhances casting quality while extending pump life and allows for more precise control over flow and pressure.

In addition, the present invention is simpler and less expensive to produce than the two-chamber pump disclosed in U.S. Pat. No. 6,103,182. Also, the operation of the pump is quicker in that only a single chamber needs to be filled. In contrast, the material in the previous pump needed to pass through an additional valve and fill a second chamber. The pump according to the present invention is more versatile in that the riser can be made external to the dispensing chamber. Not only does this reduce the chance of leakage by eliminating the gas seal around the top of the riser tube, it also allows greater room for the heater and insulation around the top of the riser and allows access to the top of the dispensing chamber. Finally, the present invention allows the possibility of connecting two or more pumps to a common riser, thus increasing the amount of metal that can be dispensed per unit time from a single riser.

When compared to an EM pump, the maintenance of the melt at the stand-by level is much safer and more reliable. When using an EM pump, the molten material can be maintained at a high level even during the re-charging of the furnace, but only so long as there is no loss of electrical power. The maintenance of the material at a high level in the riser depends on an active power system. In addition, the provision of electrical power to drive the pump in this "stalled" mode creates significant stirring of the liquid metal in the internal volume of the pump. In addition, there is also the possibility with EM pumps of software faults or main voltage fluctuations, which can cause the melt to overflow unpredictably from the casting station and pose a serious threat to the safety of operating personnel. Also, with an EM pump, oxides can accumulate at the top of the riser tube when the pump is used this way for long periods. It is thought that these oxides are created by air entrainment through the permeable ceramic, or through the joints between the ceramic components of the pump, due to the recirculating action of the liquid.

The present invention, on the other hand, is unique in that the molten material can be held at the top of the riser indefinitely in all circumstances such as the recharging of the furnace with additional metal, even when all services to the pump (electricity, gas, compressed air) are cut off. In addition, because the mechanism holding the material in the riser requires no power, the melt sits passively with no deleterious stirring induced in the pump.

The present invention combines the advantages of the EM pump with the simplicity of a pneumatic delivery system, without the disadvantages of either, thereby providing a compact pneumatic pump which has the capability to retain the melt at a high level, just below the top of the riser tube, at all times during the sequential production of castings, thus minimizing the creation of oxides.

Such apparatus may be used in dispensing molten metal, for example aluminum-based or magnesium-based alloys, into molds for manufacturing castings. The apparatus finds particular usefulness in dispensing molten aluminum alloys designed for wrought applications that have either no silicon or have only low levels of silicon, which are particularly prone to oxide formation.

The invention has been described with reference to various preferred embodiments. Modifications and alterations will occur to others upon a reading and understanding of the specification. The invention is intended to include all such modifications and alterations insofar as they come within the scope of the appended claims and the equivalents thereof.

What is claimed is:

1. An apparatus for dispensing a molten material from a reservoir of molten material, said apparatus comprising:

a dispensing chamber in communication with said reservoir;

a first valve adapted to regulate communication of said dispensing chamber with said reservoir;

a pressure variation means in communication with said dispensing chamber;

a riser communicating with said dispensing chamber for dispensing the molten material; and a second valve located beneath and operatively associated with a bottom inlet opening of said riser, said second valve being adapted to regulate communication of said dispensing chamber with said riser.

2. The apparatus of claim 1, wherein said pressure variation means comprises a valve through which a vacuum may be applied or a pressurized gas may be introduced into said dispensing chamber.

3. The apparatus of claim 1, wherein said dispensing chamber is made from a material selected from the group consisting of iron, mild steel, and ferritic stainless steel.

4. The apparatus of claim 1, wherein said dispensing chamber is made from a refractory material selected from the group consisting of clay/graphite refractory materials, clay/silicon carbide refractory materials, clay/fused silica materials, silicon carbide-based ceramics, silicon nitride-based ceramics, and related ceramics including sialon, and fused silica-based refractories that have been converted to a mixture of corundum and aluminum.

5. The apparatus of claim 1, further comprising a heater located adjacent said riser for heating said riser.

6. The apparatus of claim 5, further comprising a layer of insulation material positioned radially outwardly of said heater for retarding an outflow of heat from said riser.

7. The apparatus of claim 1, wherein said first valve comprises a stopper-rod that cooperates with a valve seat.

8. The apparatus of claim 7, further comprising a ball of refractory material positioned between said stopper rod and said valve seat.

9. A pump for dispensing a melt from a reservoir of melt, said pump comprising:

a dispensing chamber in communication with said reservoir;

a first melt valve adapted to regulate communication of said dispensing chamber with said reservoir;

a J-shaped riser communicating at lower end thereof with said dispensing chamber for dispensing the melt;

a second melt valve cooperating with said lower end of said riser to regulate communication of said riser with said dispensing chamber;

a gas reservoir; and a gas valve for regulating a flow of gas into and out of said dispensing chamber, whereby the melt can be maintained in said riser at a level above the level of the melt in said dispensing chamber.

10. The apparatus of claim 9, further comprising a second gas valve, spaced from said first gas valve, in communication with said dispensing chamber.

11. The apparatus of claim 9, wherein said first melt valve is closable by means of a stopper-rod which cooperates with a valve seat defined on a wall of said dispensing chamber.

12. The apparatus of claim 11, wherein the said second melt valve is closable by means of stopper-rod which cooperates with a valve seat disposed on an opening of said riser.

13. The apparatus of claim 9, further comprising a ball of refractory material positioned between a rod connected to said dispensing chamber and a valve seat defined on a wall of said dispensing chamber.

14. The apparatus of claim 9, wherein said dispensing chamber is made from a refractory material selected from the group consisting of clay/graphite refractory materials, clay/silicon carbide refractory materials, clay/fused silica materials, silicon carbide-based materials, and silicon nitride-nitride-based or related ceramic materials including sialon, particularly fused-silica-based refractories that have been converted to a mixture of corundum and aluminum.

15. The apparatus of claim 9, wherein said dispensing chamber is made from a material selected from the group consisting of iron, mild steel and ferrite steel.

16. The apparatus of claim 9, wherein said riser is located externally of the dispensing chamber.

17. The apparatus of claim 9, wherein said riser lower end is provided with an upwardly directed opening.

18. The apparatus of claim 9, wherein said second valve comprises a hemispherical stop valve supported and actuated by one or more rods and designed to engage with a conical seating at a base of the riser to form a seal when said second valve is closed.

19. The apparatus of claim 9, further comprising a heater for heating said riser.

20. An apparatus for continuously dispensing a molten material from a reservoir of molten material, said apparatus comprising:

at least two dispensing chambers in communication with said reservoir;

a first set of valves adapted to regulate communication of each of said two dispensing chambers with said reservoir, each of said dispensing chambers having at least one of said first set of valves;

at least one riser located between said at least two dispensing chambers and communicating with said at least two dispensing chambers for dispensing said molten material; and a second set of valves, each operatively associated with an end of said at least one riser adapted to regulate communication of said at least one riser with said at least two dispensing chambers, wherein the molten material can be maintained in said at least one riser at a level above the level of the molten material in said at least two dispensing chambers.

21. The apparatus of claim 20, further comprising at least one pressure variation means communicating with at least one of said at least two dispensing chambers.

22. The apparatus of claim 20, further comprising a heater for heating said at least one riser.

23. A method for reducing the inclusion of oxides in a casting of a molten metal, comprising the steps of:

a) providing a reservoir of a molten metal, a dispensing chamber communicating with said reservoir and a riser communicating with said dispensing chamber;

b) flowing the molten metal from said reservoir into said dispensing chamber;

c) flowing the molten metal from said dispensing chamber into said riser;

d) discharging the molten metal from said riser;

e) terminating the step of discharging;

f) holding the molten metal at a predetermined level in said riser by closing a valve operatively associated with an end of said riser, said predetermined level being above a level of the molten metal in said dispensing chamber; and g) heating said riser adjacent said predetermined level.

24. The method according to claim 23, wherein the step of discharging the molten metal from said dispensing chamber comprises the subsidiary step of pressurizing said dispensing chamber to a desired pressure.

25. The method according to claim 24, further comprising the step of monitoring a pressure in said dispensing chamber.

26. The method according to claim 24, wherein the step of pressurizing the dispensing chamber comprises the subsidiary step of contacting the molten metal with a pressurized gas.

27. The method according to claim 23, wherein the step of holding the molten metal at a predetermined level in said riser comprises the subsidiary step of maintaining the molten metal in said riser at a level higher than the level of the molten metal in said reservoir.

28. The method according to claim 23, further comprising the steps of:

h) flowing additional molten metal from said reservoir into said dispensing chamber; and i) repeating steps c) through f), whereby a continuous cycle of operations of filling said dispensing chamber and discharging molten metal from said riser is conducted.

29. The method according to claim 23, further comprising the step of urging the molten metal upwards in said riser between steps c) and d).

30. A method for reducing the inclusion of oxides in a casting of molten metal, comprising the steps of:

a) providing a reservoir of a molten metal, a dispensing chamber communicating with said reservoir and a riser communicating with said dispensing chamber;

b) flowing the molten metal from said reservoir into said dispensing chamber;

c) flowing the metal from said dispensing chamber into said riser;

d) urging the molten metal upwards in said riser to an upper opening in said riser;

e) discharging the molten metal from said riser;

f) terminating the step of discharging;

g) holding the molten metal at a predetermined level in said riser by closing a valve operatively associated with an end of said riser, said predetermined level being above a level of the molten metal in said dispensing chamber; and h) heating said riser adjacent said predetermined level.

31. The method according to claim 30, wherein the step of discharging the molten metal from said riser comprises the subsidiary step of pressurizing said dispensing chamber to a desired pressure.

32. The method according to claim 31, wherein the step of pressurizing said dispensing chamber comprises the subsidiary steps of:

preventing communication of said dispensing chamber with said reservoir;

admitting a gas into said dispensing chamber above the level of the molten metal held in said dispensing chamber; and urging the molten metal in said dispensing chamber to enter said riser.

33. The method according to claim 32, further comprising the step of monitoring a gas pressure in said dispensing chamber.

34. The method according to claim 30, further comprising the steps of:

j) flowing additional molten metal from said reservoir into said dispensing chamber; and k) repeating steps c) through h), whereby a continuous cycle of operations of filling said dispensing chamber and discharging molten metal from said riser is conducted.

35. The method according to claim 30, wherein the step of flowing the liquid metal from said reservoir to said dispensing chamber comprises the subsidiary step of selectively communicating said dispensing chamber with said reservoir.

36. The method according to claim 30, further comprising the step of retarding a loss of heat from said riser.

37. The apparatus of claim 20 wherein said at least one riser comprises a stem and a pair of branches, each communicating with a respective one of the at least two dispensing chambers.

38. The apparatus of claim 37 wherein said stem of said at least one riser is spaced from said at least two dispensing chambers.

39. The apparatus of claim 37 wherein at least a portion of said pair of branches is curved.

* * * * *